US006289536B1

(12) United States Patent
Betson

(10) Patent No.: US 6,289,536 B1
(45) Date of Patent: Sep. 18, 2001

(54) APPARATUS FOR HANDLING INCAPACITATED PATIENTS

(76) Inventor: Simon Betson, Coolevin House, Lucan Road, Post Office Box 3941, Dublin 22 (IE)

( * ) Notice: Subject to any disclaimer, the term of this patent is extended or adjusted under 35 U.S.C. 154(b) by 0 days.

(21) Appl. No.: 09/077,848

(22) PCT Filed: Dec. 6, 1996

(86) PCT No.: PCT/IE96/00083

§ 371 Date: Jun. 4, 1998

§ 102(e) Date: Jun. 4, 1998

(87) PCT Pub. No.: WO97/20534

PCT Pub. Date: Jun. 12, 1997

(30) Foreign Application Priority Data

Dec. 6, 1995 (IE) ..... S950923

(51) Int. Cl.[7] ..... A61G 7/10
(52) U.S. Cl. ..... 5/618; 5/613; 5/617; 5/624
(58) Field of Search ..... 5/618, 617, 624, 5/621, 612, 613, 619

(56) References Cited

U.S. PATENT DOCUMENTS

| | | | | |
|---|---|---|---|---|
| 2,373,018 | | 4/1945 | Deckert | 5/69 |
| 2,472,675 | * | 6/1949 | Mueller | 5/624 X |
| 3,138,805 | * | 6/1964 | Piazza | 5/618 |
| 3,312,985 | | 4/1967 | Callaghan | 5/66 |
| 4,006,499 | | 2/1977 | Young | 5/62 |
| 4,240,169 | | 12/1980 | Roos | 5/60 |
| 4,737,997 | | 4/1988 | Lamson | 5/81 R |
| 4,805,249 | * | 2/1989 | Usman et al. | 5/619 |
| 5,095,561 | * | 3/1992 | Green et al. | 5/618 |
| 5,308,359 | * | 5/1994 | Lossing | 5/617 |
| 5,379,468 | | 1/1995 | Cassidy et al. | 5/86.1 |
| 5,444,883 | * | 8/1995 | Iura | 5/618 |
| 5,454,126 | * | 10/1995 | Foster et al. | 5/618 |

FOREIGN PATENT DOCUMENTS

| | | |
|---|---|---|
| 949470 | 8/1949 | (FR) . |
| WO 94/27547 | 12/1994 | (WO) . |

* cited by examiner

*Primary Examiner*—Terry Lee Melius
*Assistant Examiner*—Fredrick Conley
(74) *Attorney, Agent, or Firm*—Madson & Metcalf

(57) ABSTRACT

An apparatus for handling incapacitated patients is disclosed in one presently preferred embodiment of the present invention as including a bed (1) having a base frame (2) which supports a central panel (5) for supporting the patient's bottom, a second panel (8) and a third panel (9) for supporting the upper and lower parts, respectively, of the patient's legs and a fourth panel (6) for supporting the patient's back, there being drive means for displacing the panels such that in one configuration their upper surfaces lie in a single horizontal plane and in another configuration adjacent panels are inclined with respect to each other, characterized in that the apparatus further includes a leg support (12) which is displaceable into and out of a position in which it forms a local widening of the bed (1), in which position it can support the lower parts of the patient's legs when the patient is in an attitude in which the legs are straight or are bent and the patient is lying on his side, and further characterized by a patient support (250) having a seat portion and a back portion, the patient support (250) being supported by the bed (11), the apparatus being such that when the patient is in said attitude said seat portion may be interposed between the patient's bottom and upper parts of the legs, on the one hand, and the second panel (8) when upright, on the other hand, with the back portion of the patient support (250) adjacent the patient's back, and the fourth panel (6) may be brought upright by said drive means to cause the patient to adopt a sitting position on the patient support (250).

24 Claims, 6 Drawing Sheets

APPARATUS FOR HANDLING INCAPACITATED PATIENTS

BACKGROUND OF THE INVENTION

1. The Field of the Invention

This invention relates to apparatus for supporting a patient comprising a bed.

2. Background

U.S. Patent Specification No. 4,006,499 discloses a patient's bed having a base frame which supports a central panel for supporting the patient's bottom, a second panel and a third panel for supporting the upper and lower parts, respectively, of the patient's legs and a fourth panel for supporting the patient's back. There are drive means for displacing the panels such that in one configuration their upper surfaces lie in a single horizontal plane and in another configuration adjacent panels are inclined with respect to each other such that the patient is supported in a sitting position with his back and the lower parts of his legs inclined in the same sense to the vertical and the upper parts of his legs horizontal. There is no disclosure of the possibility of using the drive means to assist the patient in leaving the bed other than by causing him to stand upright preparatory to walking.

French Patent Specification No. 949,470 discloses a patient's trolley in which a panel at one end can be lifted, presumably manually, from a horizontal position to an inclined position to raise the patient's head. A side bar of the trolley is constructed to support various accessories which can be slid along it, including a leg support which forms a local widening of the trolley and is designed to support the lower part of one leg of the patient when heis lying on his back with that one leg projecting beyond one side of the trolley proper. The leg support always forms a local widening of the trolley, wherever the leg support is situated, until it is removed entirely from the trolley.

U.S. Patent Specification No. 4,737,997 discloses a method of transferring a patient from a bed to a wheelchair without using electrical or other power other than manual power. starting from the situation where the patient is lying on one of his sides on the bed, a patient support having a seat portion and a back portion is placed on the bed, with the seat portion engaging the patient's bottom and the upper parts of his legs and the back portion engaging the patient's back. Then the patient support is strapped to the patient and the two are rolled over by an assistant until the patient is sitting on the seat portion with the lower parts of his legs dangling over the side of the bed or projecting beyond it. A buggy is then advanced towards the bed, secured to the patient support and backed away from the bed to carry the patient away from the bed. A wheel chair is then moved towards the patient from behind him until the seat portion and the back portion of the patient support are close to the seat and back portions of the wheelchair and the buggy is then disconnected from the patient support and removed, leaving the patient seated on the wheelchair. The operation of rolling the patient over, with the patient support strapped to him, would be difficult, especially in the case of a heavy patient.

BRIEF SUMMARY OF THE INVENTION

It is an object of the invention to provide a bed having a plurality of possible configurations and from which a patient can be removed in a sitting position using motive power which is provided on the bed for changing the configuration of the bed.

According to the invention, there is provided an apparatus for supporting a patient comprising a bed having a base frame which supports a central panel for supporting the patient's bottom, a second panel and a third panel for supporting the upper and lower parts, respectively, of the patient's legs and a fourth panel for supporting the patient's back, there being conventional drive means for displacing the panels such that in one configuration their upper surfaces lie in a single horizontal plane and in another configuration adjacent panels are inclined with respect to each other, characterised in that the apparatus further includes a leg support which is displaceable into and out of a position in which it forms a local widening of the bed, in which position it can support the lower parts of the patient's legs when the patient is in an attitude in which the legs are straight or are bent and the patient is lying on his side, and further characterized by a patient seat support having a seat portion and a back portion, the patient seat support being supported by the bed, the apparatus being such that when the patient is in said attitude said seat portion may be interposed between the patient's bottom and upper parts of the legs, on the one hand, and the second panel when upright, on the other hand, with the back portion of the patient seat support adjacent the patient's back, and the fourth panel may be brought upright by said drive means to cause the patient to adopt a sitting position on the patient seat support.

The leg support is preferably pivotally mounted on the bed.

To assist in causing the patient to lie on his side, the bed may be rotated about on axis extending horizontally along the bed and then rotated back again.

To assist in placing the patient seat support in an optimum position on the bed, in relation to the patient, there are preferably means whereby the fourth panel can be brought into a position in which its upper surface is parallel to, but in a higher plane than, the upper surface of the central panel. Preferable there are means for interlocking the central panel and the fourth panel so that they may be pivoted together to bring the fourth panel upright.

When the patient seat support is upright and the patient is sitting on it on the bed, a buggy is preferably engaged with the patient support and used to transport the patient away from the bed.

If the leg support is pivotally mounted on the central axle or on the fourth panel, the leg support does not impede use of the buggy because it swings out of the buggy's path.

BRIEF DESCRIPTION OF THE DRAWING

An example in accordance with the invention is described below with reference to the accompanying drawings, in which.

DETAILED DESCRIPTION OF THE PREFERRED EMBODIMENTS

Figure 1:
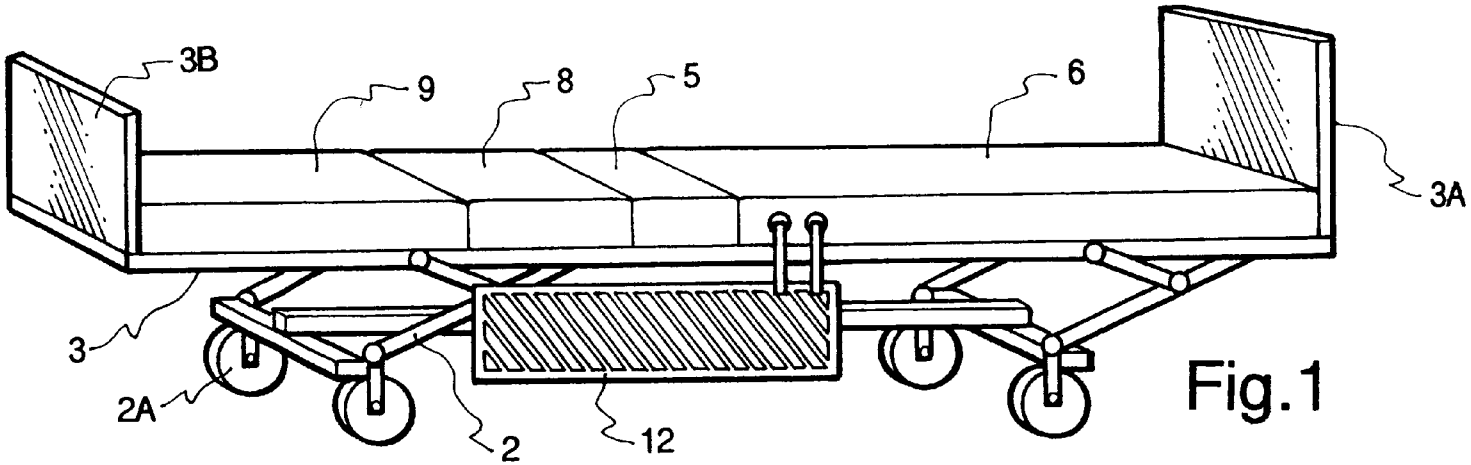
FIGS. 1 and 2 show diagrammatical views, from one side, of a bed with relatively movable parts in differing orientations.

The illustrated bed 1 includes a base frame 2 on which are mounted wheels 2A and a patient support 3 having an upstanding head board 3A and foot board 3B. On the support 3 are a central panel 5 for supporting the patient's bottom, a second panel 8 for supporting the upper parts of the patient's legs, a third panel 9 for supporting the lower parts of the patient's legs and a fourth panel 6 for supporting the patient's back, shoulders and head. A leg support 12 is displaceable from a storage position below the support 3, as shown in FIG. 1, to an in-use position, shown in FIG. 2, in which it forms a local widening of the bed and can support the lower parts (below the knees) of the patient's legs when the patient is in an attitude in which the legs are bent at the knees and the patient is lying on his side. In the illustrated case, the leg support 12 is large enough to underlie also the upper parts (above the knees) of the patient's legs when the patient is in the above-mentioned attitude.

Figure 2:
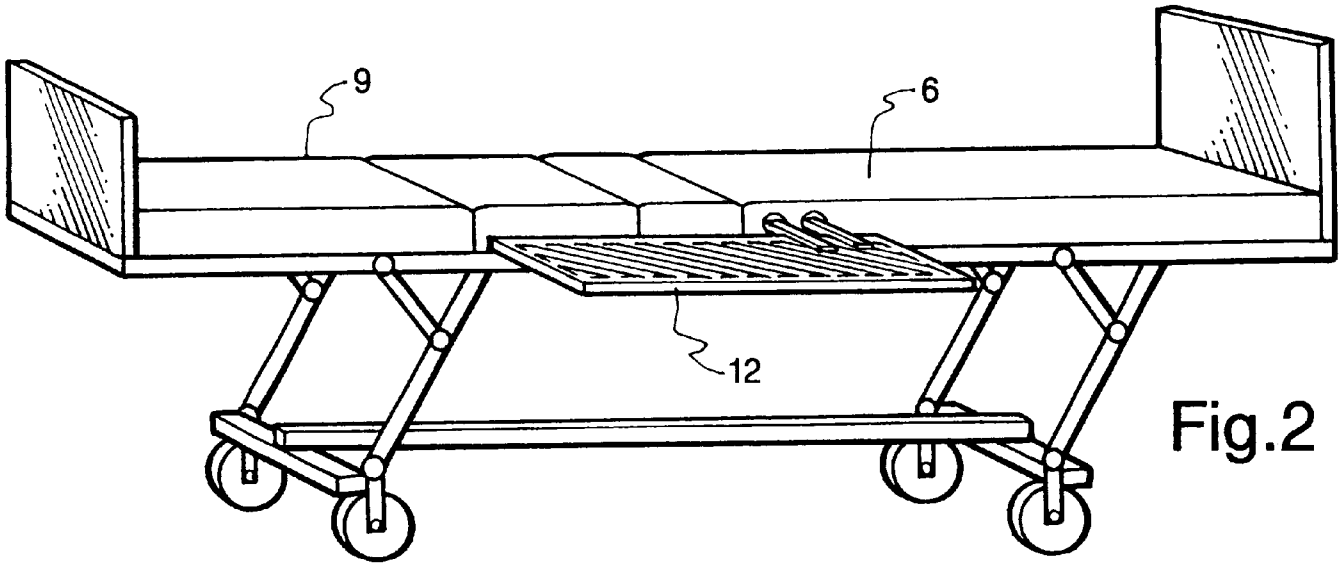

The frame 2 includes pivotally-connected struts which enable the support 3 to be raised from the position shown in FIG. 1 to the position shown in FIG. 2, relative to the wheels 2A.

There are conventional drive means, not shown in FIGS. 1 to 5, for displacing the panels such that in one configuration, shown in FIGS. 1 and 2, their upper surfaces lie in a single horizontal plane and in other configurations adjacent panels are inclined with respect to one another. Thus in FIG. 4 the panel 8 is shown substantially vertical and the panel 9 inclined by a little more than 30° to the horizontal, whilst in FIG. 5 the panels 5 and 6 are shown vertical and the panels 8 and 9 horizontal. In another configuration, not shown, the panels 8 and 9 are inclined in opposite senses to the horizontal and the panel 6 is inclined to the horizontal in the same sense as the panel 9, so that the knees are the highest parts of the patient's legs and the patient's head is higher still, with his back inclined. The angles of inclination can be chosen from several angles for each of panels 6, 8 and 9.

Figure 3:
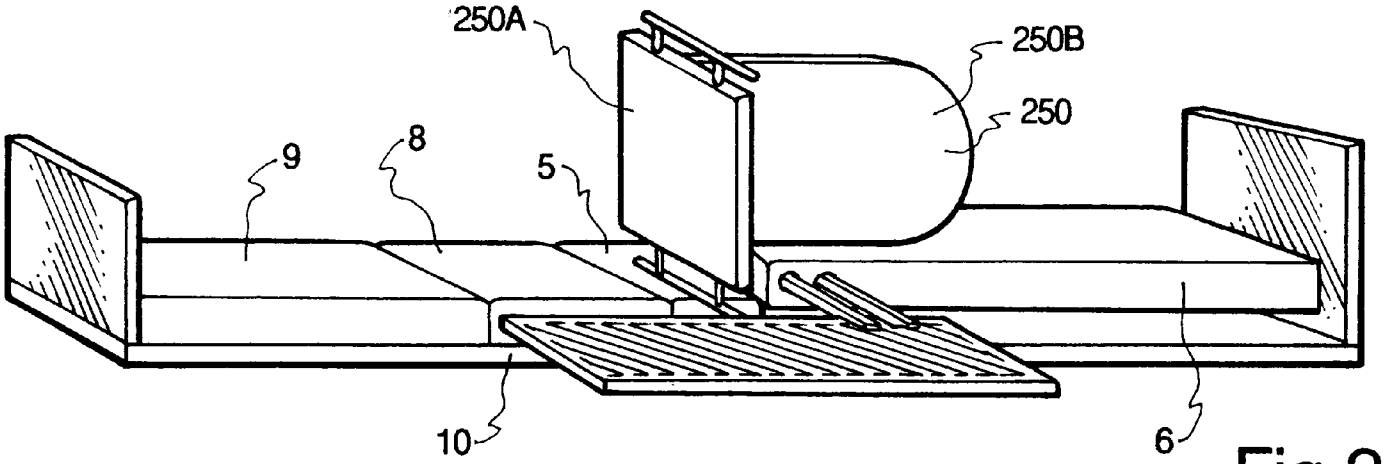
FIGS. 3 to 5 show diagrammatically upper parts of the same bed and a patient support positioned on it, the support and movable parts of the bed being shown in differing orientations.
Figure 4:
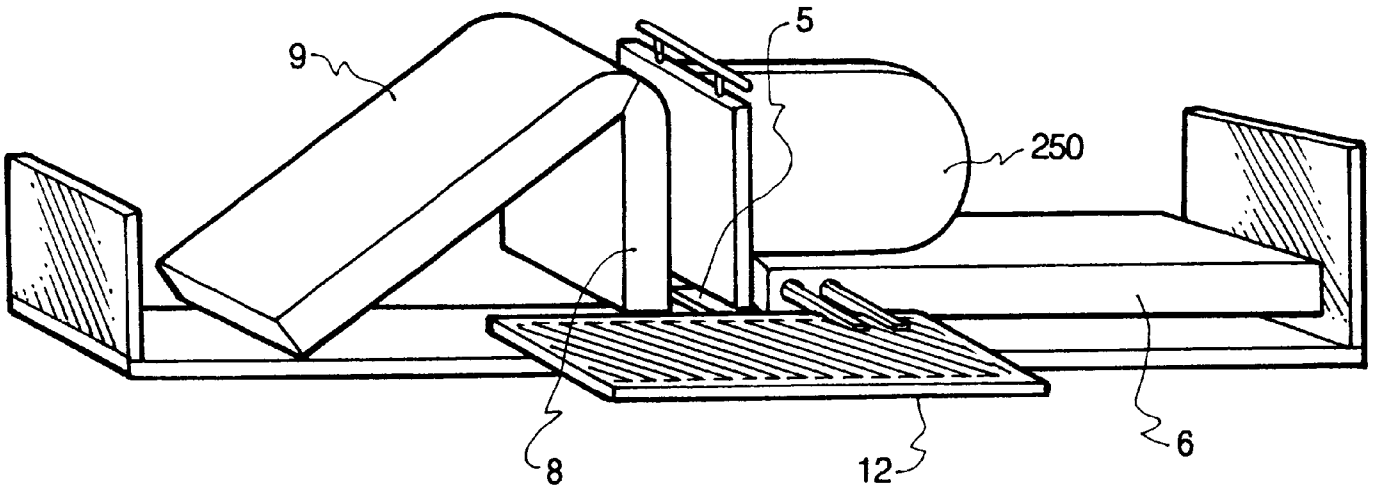

By operation of further driving means the panel 6 can be brought into a position, shown in FIG. 3, in which its upper surface is parallel to, but in a higher plane than, the upper surfaces of the panels 5, 8 and 9. FIG. 4 also shows the panel 6 raised with respect to the panel 5. This results in the leg support 12 also being raised.

A patient seat support 250 is supported by the bed 1 when the patient is to be removed from the bed. It is like a chair with no legs and thus comprises a seat portion 250A and a back portion 250B. When the patient is in the above-mentioned attitude on the bed, with at least the lower parts of his legs supported by the leg support 12, the seat portion 250A may be interposed between the patient's bottom and upper parts of the legs, on the one hand, and the panel 8 when upright, on the other hand, with the back portion 250B lying along the patient's back. The patient seat support 250 may be positioned either before or after the panel 8 is brought to its upright position but preferably after the panel 6 has been raised with respect to the panel 5.

Figure 5:
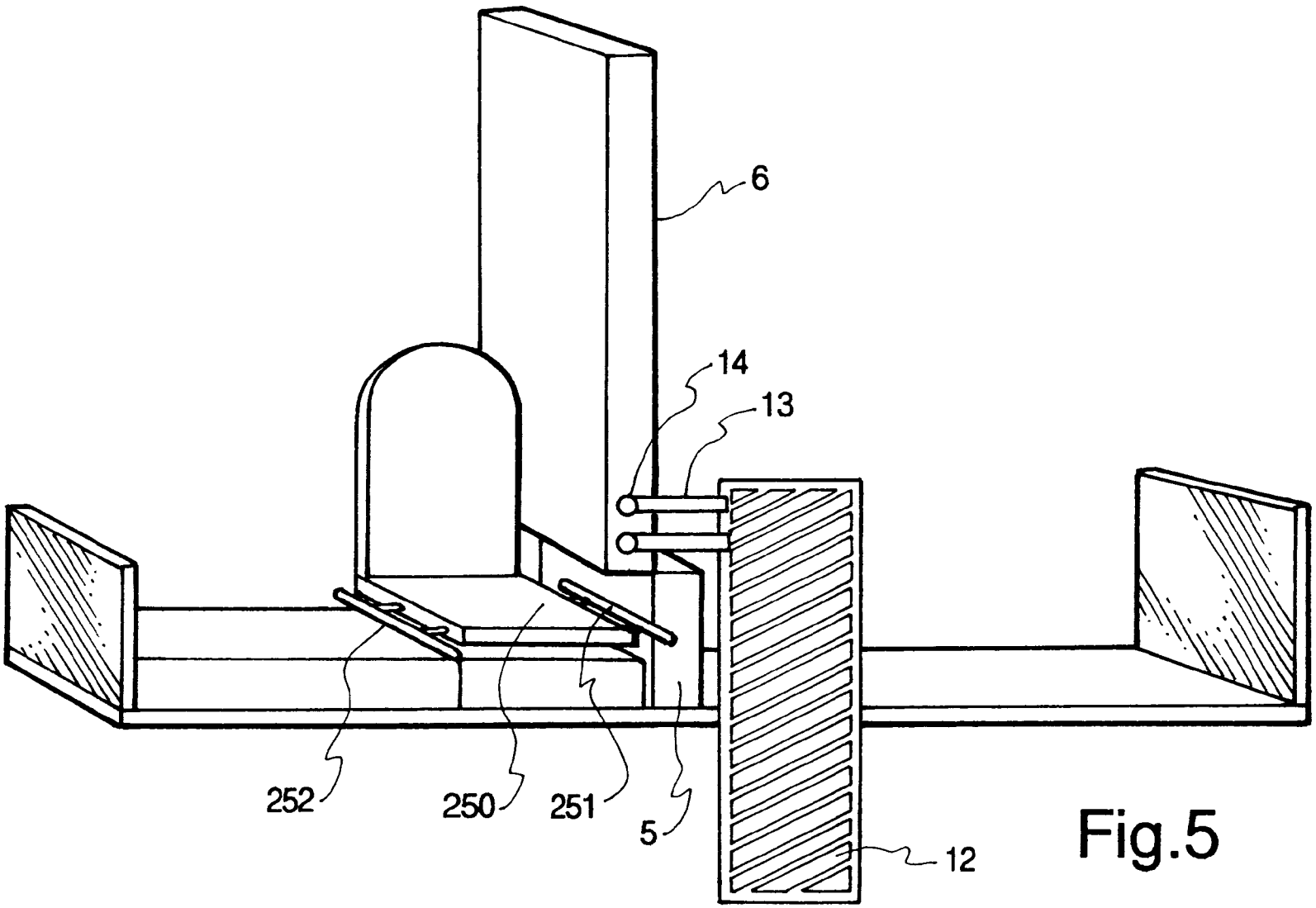

The panels 5 and 6 are locked together, by means not shown in FIGS. 1 to 5, and then the drive means are operated to bring the panels 5 and 6 from their horizontal positions, shown in FIG. 4, to vertical positions, shown in FIG. 5, and to bring the panels 8 and 9 back to their horizontal positions. This causes the seat portion 250A to adopt a horizontal position with the patient's forelegs hanging over the side of the bed, no longer in contact with the leg support 12 which has moved out of the way by means of two arcuate rods 13 fixed to the leg support 12 and sliding in tubes 14 fixed to the panel 6.

Raising the panel 6 with respect to the panel 5, leaving a step 10 shown in FIG. 3, facilitates positioning of the patient seat support 250 and ensures that the patient will be more nearly centrally seated on the seat portion 250A.

Figure 6:
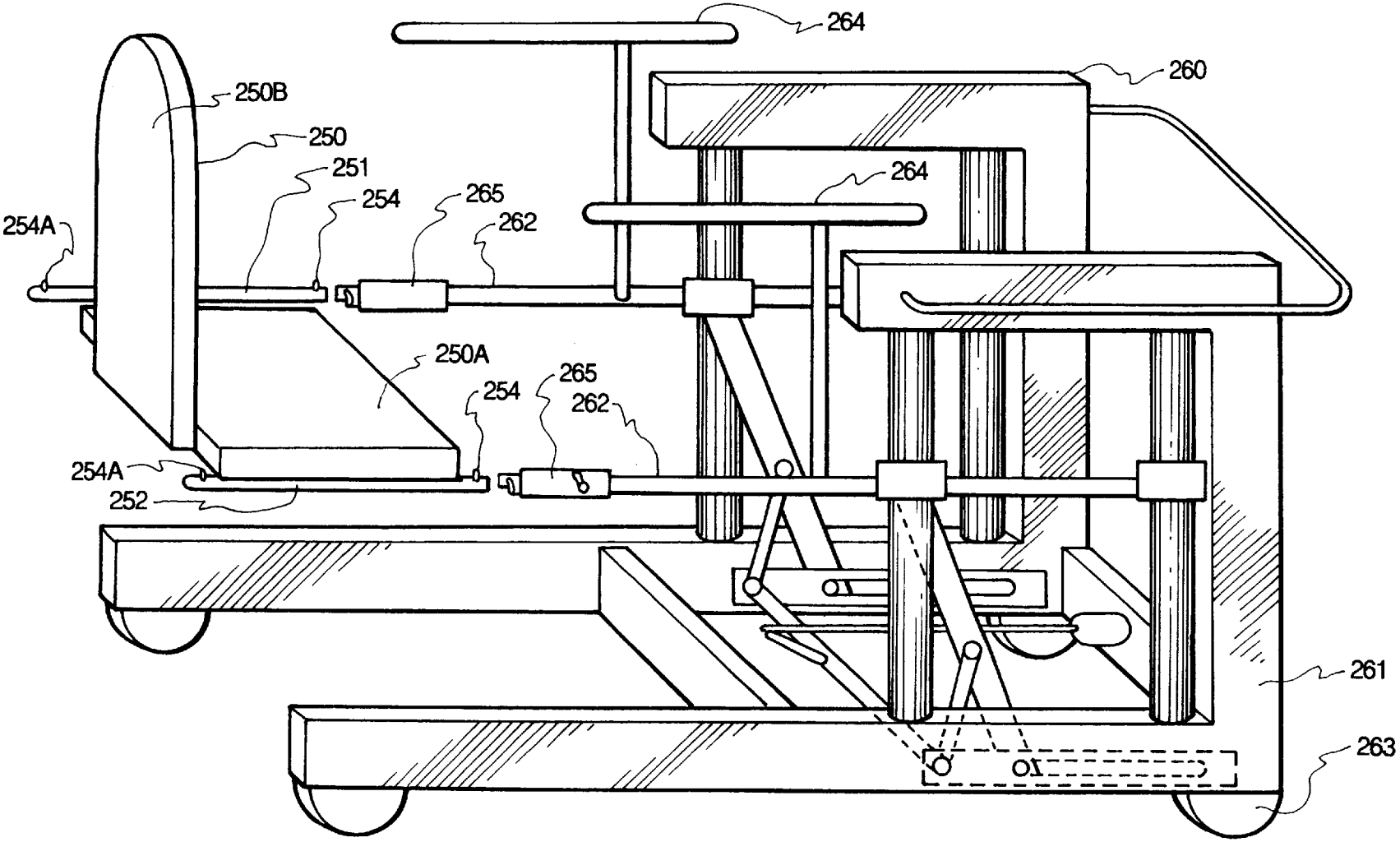
FIG. 6 shows diagrammatically the same patient support and a buggy for carrying it.

FIG. 6 shows the patient seat support 250 in the orientation which it has when it is on the bed with the patient sitting on its seat portion 250A and also shows a buggy 260 which can be used to carry the patient, still on the patient seat support 250, away from the bed. The buggy includes a chassis 261 on which wheels 263 are mounted, the chassis supporting tubular arms 262 on which rotatable tubular connectors 265 are mounted. Rails 251 and 252 are mounted on the patient support 250 on opposite sides of the seat portion 250A. Each of the rails has an upstanding pin 254 near one end and a similar pin 254A near the other end. The buggy is caused to advance towards the bed, the leading end of the chassis 261 passing under the bed, and the rails 251 enter the tubular arms 262 until the pins 254A enter the connectors 265, which are then rotated to secure the patient seat support 250 to the buggy 260, which can then be backed away from the bed. Side bars 264 prevent the patient rolling sideways and he may grip them if desired. It will be appreciated that the buggy incorporates drive means to facilitate the raising and lowering of the patient seat support 250.

Figure 7:
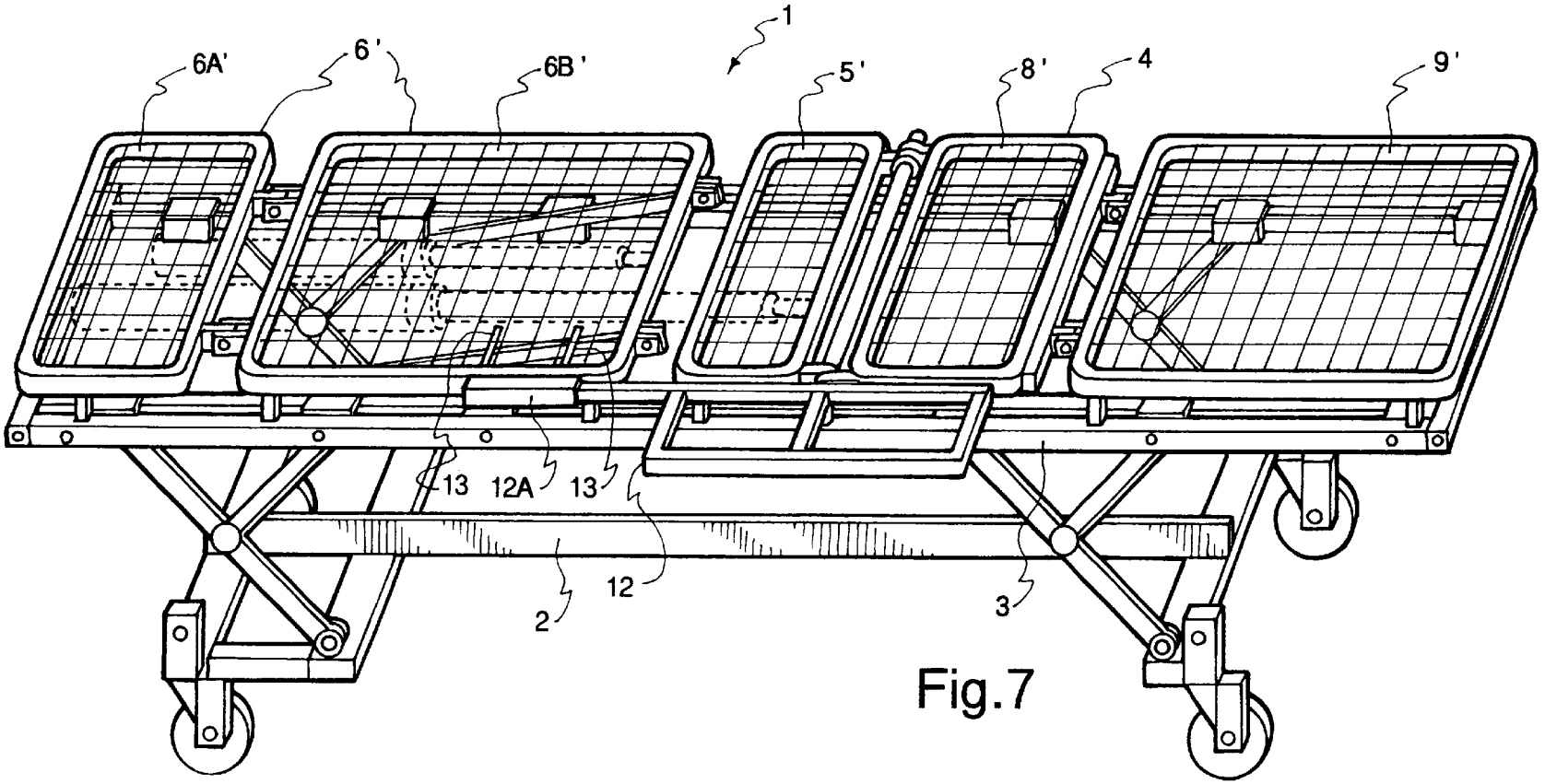
FIG. 7 shows a view, from the opposite side, of details of the bed.
Figure 8:
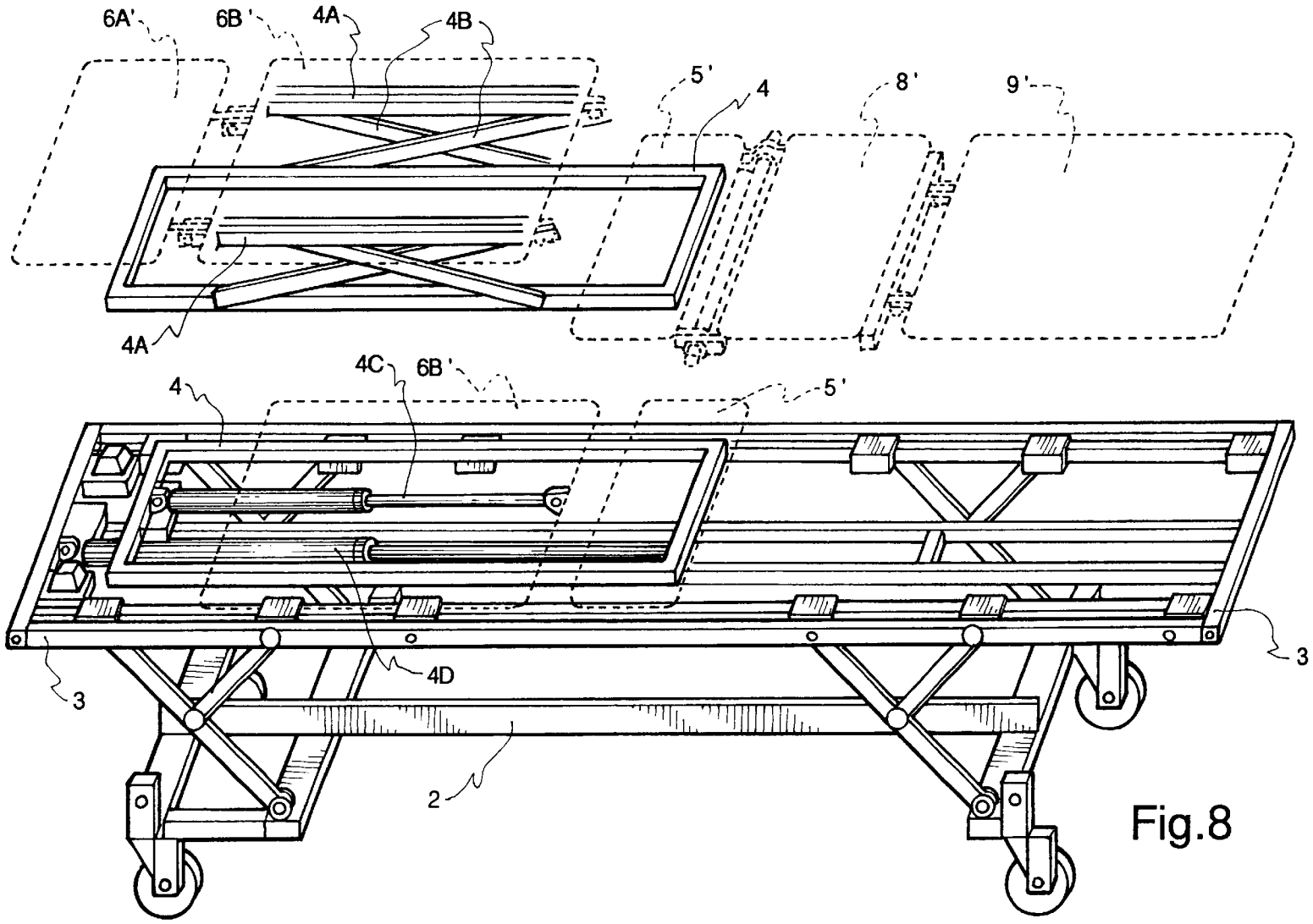
FIG. 8 shows an exploded view corresponding to FIG. 7, showing further details of the bed.

Each of the panels 5, 6, 8 and 9 shown in FIGS. 1 to 5 consists of a rigid panel base and a portion of mattress laid on it, the panel bases and mattress portions not being shown separately. In FIGS. 7 and 8 the panel bases are shown but the mattress portions have been omitted.

FIGS. 7 and 8 show some details of a bed 1 which is similar in principle to the bed shown in FIGS. 1 to 5. The patient support 3 supports a sub-frame 4 which in turn supports parallel bars 4A which can be raised, to cause the panel 6 to rise with respect to the panel 5, by struts 4B arranged scissor-fashion and by a ram 4C. Here the panel 6 is subdivided into a head-supporting panel and a back-supporting panel, the two panel bases 6A' and 6B' being pivotally connected to each other as shown in FIG. 8, so that the patient's head may be raised.

As shown in FIG. 7, panel bases 5' and 8' are pivotally connected together, as are panel bases 9' and 8', and each of the panel bases 6A', 6B', 5', 8' and 9' consists of a rectangular frame with thin elements stretched across it to form a lattice. On the panel bases will be laid a mattress, not shown, possibly consisting of individual parts, for example one on panel bases 6A' and 6B' and one on panel bases 5', 8' and 9'. The leg support 12 here is shown as a framework which lies in a horizontal plane in the in-use position but can be swung into a storage position in which the framework lies in a vertical plane. A bar 12A extends from the leg support 12 and has the rods 13 mounted on it.

It will be readily appreciated that in many instances the construction elements of the apparatus may be modified and/or varied by use of mechanical equivalents without departing from the scope of the invention.

What is claimed and desired to be secured by United States Letters Patent is:

1. An apparatus for supporting a body of a patient, the apparatus comprising:

a bed comprising:

a frame;

a central panel supported by the frame, the central panel having an upper major surface;

a second panel supported by the frame, the second panel having an upper major surface;

a third panel supported by the frame, the third panel having an upper major surface;

a fourth panel supported by the frame, the fourth panel having an upper major surface;

a drive means for displacing the panels between a first configuration wherein the upper major surface of each of the panels lie in a single horizontal plane and a second configuration wherein adjacent panels are adapted to be selectively inclined with respect to each other, the drive means comprising a linear actuator operable disposed between the frame and the second panel, the central panel, and the fourth panel, wherein upon extending a length of the actuator, the second panel pivots into a substantially upright position relative to the frame and upon retracting the length of the actuator, the second panel pivots into a substantially horizontal position in relative to the frame, while the central panel and the fourth panel pivot into a substantially upright position relative to the frame; and a leg support supported by the frame, the leg support being selectively displaceable between a storage position and an engaged position wherein the leg support provides a local widening of the bed;

a patient seat support adapted to be selectively supported by the bed, the patient seat support comprising a seat portion and a back portion disposed substantially perpendicular to the seat portion, the seat portion being configured to be selectively positionable between a first position wherein the seat portion is disposed substantially perpendicular to the frame and a second position wherein the seat portion is disposed substantially parallel to the frame;

wherein the seat portion of the patient seat support is disposed in the second position when the fourth panel of the bed is selectively positionable in the upright position by the drive means such that the patient adopts a sitting position on the patient seat support; and wherein the drive means further comprises a linear extendible ram and height-adjustable parallel support bars connected between the frame in the fourth panel which in combination with retraction of the linear actuator, assist in facilitating the disposition of the fourth panel into the upright position.

2. An apparatus as claimed in claim 1 further comprising means whereby the fourth panel can be brought into a position in which the upper major surface of the fourth panel is parallel to, but in a higher plane than, the upper surface of the central panel.

3. An apparatus as claimed in claim 1 further comprising means for interlocking the central panel and the fourth panel, whereby the central panel and the fourth panel are adapted to be pivoted together to bring the fourth panel upright.

4. An apparatus as claimed in claim 1 wherein the leg support is pivotally mounted on the fourth panel.

5. An apparatus as claimed in claim 4 wherein the pivotal mounting of the leg support in relation to the fourth panel comprises two arcuate rods fixed to the leg support and two tubes fixed to the fourth panel in which the two arcuate rods slide.

6. An apparatus as claimed in claim 1 wherein the leg support is movable simultaneously with the drive means, the second panel and the third panel are hingedly interconnected for relative movement of the second and third panels between an in-line flat position and an angled position, the fourth panel being pivotally moveable relative to the central panel, each of the panels being operable to be in alignment to define a horizontal position, the drive means being operable to raise and lower the fourth panel in a torso mode and raise and lower the fourth panel in an inclined position, with means being provided to secure the fourth panel in the torso or inclined positions, the fourth panel being operable to be raised and locked in the torso mode to form a stepped configuration with the central panel, the second panel being pivotable upwardly into a generally vertical position with the third panel to lie into an inclined position, whereby the patient seat support is placed in position behind the patient with the seat portion resting between the patient and the second panel and the back portion extending upwardly along the patient's back, and with the interlocked fourth panel and central panel being operable to be pivoted upwardly on the frame into an upright position whereby the fourth panel is moved to a position with its upper major surface parallel to, but in a higher plane than, the upper major surface of the central panel, the second panel and the third panel.

7. An apparatus as claimed in claim 6 wherein the leg support rotates with the fourth panel when said fourth panel is pivoted upwardly on the frame into an upright position.

8. An apparatus as claimed in claim 1 wherein the patient seat support is positionable in an upright position and adapted to engaged with a buggy for transporting the patient support away from the bed.

9. An apparatus as claimed in claim 1 wherein each panel consists of a rigid panel base and a portion of mattress laid on the rigid base, these portions being provided by a first mattress on the panel bases of the central panel, the second panel and the third panel and a second mattress on the panel base of the fourth panel.

10. An apparatus as claimed in claim 1 wherein the frame comprises a sub-frame with the plurality of said panels being movable on the sub-frame.

11. An apparatus as claimed in claim 1 wherein the leg support is mounted at a side of the frame, the leg support being movable between a stored position underneath the frame and an engaged position extending outwardly of the frame.

12. An apparatus as claimed in claim 11 wherein the leg support is mounted on the fourth panel, such that when the patient is arranged on the patient seat support with the upper body of the patient resting on the fourth panel, the upper legs of the patient are bent and extend outwardly over the leg support which is first movable simultaneously and second rotatable simultaneously with the fourth panel.

13. An apparatus for supporting a body of a patient, the apparatus comprising:

a bed comprising:

a base frame;

a patient support platform connected to the base frame, the patient support platform being selectively movable on the base frame;

a central panel supported by the patient support platform, the central panel having an upper surface;

a second panel supported by the patient support platform and disposed contiguous the central panel, the second panel having an upper surface;

a third panel supported by the patient support platform and disposed contiguous the second panel, the third panel having an upper surface;

a fourth panel supported by the patient support platform and disposed contiguous the central panel, the fourth panel having an upper surface;

a drive means for displacing the panels between a first configuration wherein the upper surface of each of the panels lie in a single horizontal plane and a second configuration wherein adjacent panels are adapted to be selectively inclined with respect to each other; and a leg support being selectively displaceable between a storage position and an engaged position wherein the leg support provides a local widening of the bed;

a patient seat support adapted to be selectively supported by the bed, the patient seat support comprising a seat portion and a back portion disposed substantially perpendicular to the seat portion, the seat portion being configured to be selectively positionable between a first position wherein the seat portion is disposed substantially perpendicular to the frame and a second position wherein the seat portion is disposed substantially parallel to the frame; and wherein the seat portion of the patient seat support is disposed in the second position when the fourth panel of the bed is selectively positionable in an upright position by the drive means such that the patient adopts a sitting position on the patient seat support.

14. An apparatus as claimed in claim 13 further comprising means whereby the fourth panel is configured to be brought into a position in which the upper surface of the fourth panel is parallel to, but in a higher plane than, the upper surface of the central panel.

15. An apparatus as claimed in claim 14 further comprising means for interlocking the central panel and the fourth panel, whereby the central panel and fourth panel are configured to be pivoted together to bring the fourth panel upright.

16. An apparatus as claimed in claim 15 wherein the leg support is pivotally mounted on the fourth panel.

17. An apparatus as claimed in claim 16 wherein the pivotal mounting of the leg support in relation to the fourth panel comprises two arcuate rods fixed to the leg support and two tubes fixed to the fourth panel in which the two arcuate rods slide.

18. An apparatus as claimed in claim 17 wherein the leg support is movable simultaneously with the drive means, the second panel and the third panel are hingedly interconnected for relative movement of the second and third panels between an in-line flat position and an angled position, the fourth panel being pivotally moveable relative to the central panel, each of the panels being operable to be in alignment to define a horizontal position, the panel drive means being operable to raise and lower the fourth panel in a torso mode and raise and lower the fourth panel in an inclined position, with means being provided to secure the fourth panel in the torso or inclined positions, the fourth panel being operable to be raised and locked in the torso mode to form a stepped configuration with the central panel, the second panel being pivotable upwardly into a generally vertical position with the third panel to lie into an inclined position, whereby the patient seat support is placed in position behind the patient with the seat portion resting between the patient and the second panel and the back portion extending upwardly along the patient's back, and with the interlocked fourth panel and central panel being operable to be pivoted upwardly on the base frame into an upright position whereby the fourth panel is moved to a position with its upper surface parallel to but in a higher plane than, the upper surface of the central panel, the second panel and the third panel.

19. An apparatus as claimed in claim 18 wherein the leg support rotates with the fourth panel when said fourth panel is pivoted upwardly on the base frame into an upright position.

20. An apparatus as claimed in claim 19 wherein the patient seat support is positionable in an upright position and adapted to engaged with a buggy for transporting the patient support away from the bed.

21. An apparatus as claimed in claim 20 wherein each panel consists of a rigid panel base and a portion of mattress laid on the rigid base, these portions being provided by a first mattress on the panel bases of the central panel, the second panel and the third panel and a second mattress on the panel base of the fourth panel.

22. An apparatus as claimed in claim 21 wherein the base frame comprises a sub-frame with the plurality of said panels being movable on the sub-frame.

23. An apparatus as claimed in claim 22 wherein the leg support is mounted at a side of the frame, the leg support being movable between the stored position underneath the frame and the engaged position extending outwardly of the frame.

24. An apparatus as claimed in claim 23 wherein the leg support is mounted on the fourth panel, such that when the patient is arranged on the patient seat support with the upper body of the patient resting on the fourth panel, the upper legs of the patient are bent and extend outwardly over the leg support which is first movable simultaneously and second rotatable simultaneously with the fourth panel.

* * * * *